United States Patent [19]

Sharples

[11] Patent Number: 4,897,075

[45] Date of Patent: Jan. 30, 1990

[54] CENTRIFUGE DRIVE HUB

[75] Inventor: Thomas D. Sharples, Atherton, Calif.

[73] Assignee: Beckman Instruments, Inc., Fullerton, Calif.

[21] Appl. No.: 336,682

[22] Filed: Apr. 11, 1989

[51] Int. Cl.[4] ..... B04B 9/12

[52] U.S. Cl. ..... 494/84; 494/43

[58] Field of Search ..... 494/84, 85, 82, 83, 494/43, 46; 210/781, 782

[56] References Cited

U.S. PATENT DOCUMENTS

| | | | |
|---|---|---|---|
| 2,827,229 | 3/1958 | Blum | 494/84 |
| 4,101,070 | 7/1978 | Hoare | 494/84 |
| 4,205,261 | 5/1980 | Franklin | 494/16 |
| 4,781,669 | 11/1988 | Piramoon | 494/16 |

*Primary Examiner*—Robert W. Jenkins

*Attorney, Agent, or Firm*—William H. May; Paul R. Harder; Thomas Schneck

[57] ABSTRACT

A centrifuge hub-rotor drive is disclosed in which a rotor has an internal recess that fits over and interfaces with a hub. The hub has a skirt with a curved outer periphery that interfaces and contacts internal walls of the rotor which define a tapered section of the recess. The curved outer periphery of the skirt ideally meets the internal tapered walls of the rotor along a curved contact band. The outer periphery of the skirt is taken from a portion of a spheroid, regular, oblate or prolate.

14 Claims, 3 Drawing Sheets

CENTRIFUGE DRIVE HUB

TECHNICAL FIELD

The invention relates to centrifuges and more particularly to a drive interface between a centrifuge hub and rotor.

BACKGROUND ART

Centrifuges are used to separate a mixture of substances according to the mass of each component. A centrifuge includes a rotor having a plurality of chambers to receive sample containers. The chambers hold the sample containers at some fixed angle, so that as the rotor is revolved heavier components separate from lighter components.

A rotor is generally shaped like a cylinder or a cone and is removably rested upon a drive hub. A recess is provided at the base of the rotor to receive the drive hub. Originally, the hub-receiving recess of the rotor had a cylindrical configuration to receive a cylindrical hub. Such a configuration is shown in U.S. Pat. No. 4,205,261 to Franklin, assigned to the assignee of the present invention. However, modern centrifuge systems provide an ever increasing angular velocities. The modern high-speed centrifuge systems, referred to as ultracentrifuges, render cylindrical fittings less satisfactory than in lower speed centrifuges. Thus, high-speed centrifuges include a frustroconically-shaped fitting arrangement in place of a cylindrically-shaped fitting arrangement. The frustroconical shape creates a self-centering effect for the rotor seated on the drive hub. For example, the hub-engaging surface of a rotor may be at a fourteen degree angle, more or less, to the vertical. Then in manufacturing the drive hub, the upper extent of the rotor-engaging surface is curved sharply to center and support the rotor. Consequently, a line of contact is created between the drive hub and the rotor.

An ultracentrifuge rotor may experience 600,000 g or higher forces which cause the rotor to expand in size. Under full rotational speed the hub-engaging surface of the rotor increases in diameter to a much larger extent than the hub, causing the rotor to drop slightly on the hub. When the centrifuge is stopped, the rotor returns to an unstrained condition and the hub-engaging surface reduces in diameter giving rise to an interference fit with the hub along the above-described line of contact. It may take a considerable axial force to free the rotor from the hub. This is a very undesirable condition since a centrifuge separation is easily disturbed by jarring and rough handling. Furthermore, damage to the centrifuge may result from shock on the drive bearings and possible bending of the rather delicate spindle. Moreover, as the rotor expands, a small amount of tilting of the rotor on the drive hub is possible. When tilted even slightly, the contact of the hub against the rotor becomes a diametrically opposing two-point contact, rather than the intended line of contact. Thus, when the rotor drops down on the hub, the local stresses at the two contacting points will be very high and there will be a greater tendency for the hub to become embedded in the rotor.

Tapering the outer periphery of the skirt to match the taper of the rotor somewhat reduces the problem of rotor sticking. Corresponding tapers, however, place an emphasis on rigid manufacturing tolerances. Otherwise, there are still a number of possible conditions which will result in high local stresses at the hub-rotor interface which, in turn, tend to cause sticking. It is possible, for example, to have the actual mating contact at either the large diameter end or the small diameter end. Thus, the problem associated with tilting is not eliminated by employing a hub with a matching taper, since a two-point contact may still result from this configuration.

Therefore, it is an object of the present invention to design a centrifuge hub for drive engagement with rotors, wherein the force required to free a rotor from the hub is reduced. It is further an object of the present invention to eliminate the possibility of a two-point contact between a hub and a tilted rotor.

DISCLOSURE OF THE INVENTION

The above objects have been met by a centrifuge drive hub which has a skirt that creates a band of contact and not a mere line of contact. The skirt has an outwardly curved surface that provides the band of contact even after tilting of the rotor relative to the hub.

The skirt of the hub has symmetry about a vertical spin axis of the centrifuge. The radially outward surface of the skirt is a rotor-engaging surface which closely fits within a removable centrifuge rotor. The rotor-engaging surface has a smooth curvature from the lower axial extent of the surface to the upper axial extent. The maximum radius of curvature of the rotor-engaging surface is less than the radius of curvature of the rotor wall contacted by the rotor-engaging surface. Typically, the interior wall of the rotor is frustroconically shaped, so that the radius of curvature is infinite. In such case, the rotor-engaging surface is preferably a portion of a spheroid having a center of curvature which is along a vertical drive shaft axis of the hub near an imaginary pivot point of the rotor. This pivot point is the point about which the rotor will tilt as forces cause the rotor to run on its true axis of gyration.

Alternatively, the wall of a rotor may define a spherically inwardly narrowing recess to receive the hub. In such case, the ideal curved surface is a portion of a slightly offset closed torus, or doughnut, wherein the plane circle used to generate the torus has a radius somewhat smaller than that of the spherically curved wall of the rotor. The zone of contact at the hub-rotor interface should be at the center of the spherically curved wall of the rotor.

While a skirt having a shape of a portion of a spheroid or a portion of a closed torus may be ideal, other ellipsoidal shapes are possible as long as the maximum radius of curvature of the rotor-engaging surface is less than the maximum of the rotor wall. Nevertheless, the radius of curvature must be sufficiently great so as to provide a zone of contact at the hub-rotor interface. An advantage of the present invention is that even in a tilted condition, any risk of a two-point contact at the interface is substantially reduced. Thus, the possibility of high local stress concentrations, which commonly cause rotor sticking, is reduced. Another advantage is that as centrifuge rotation is ceased the interference ft resulting from the relatively greater expansion of the rotor is distributed across the entirety of the band of contact, thereby lessening the force needed to separate the rotor from the hub. Yet another advantage is that the drive hub may be retrofit to existing centrifuges with little expense. Moreover, the present invention allows for the continued use of existing rotors.

BEST MODE FOR CARRYING OUT THE INVENTION

Figure 1:
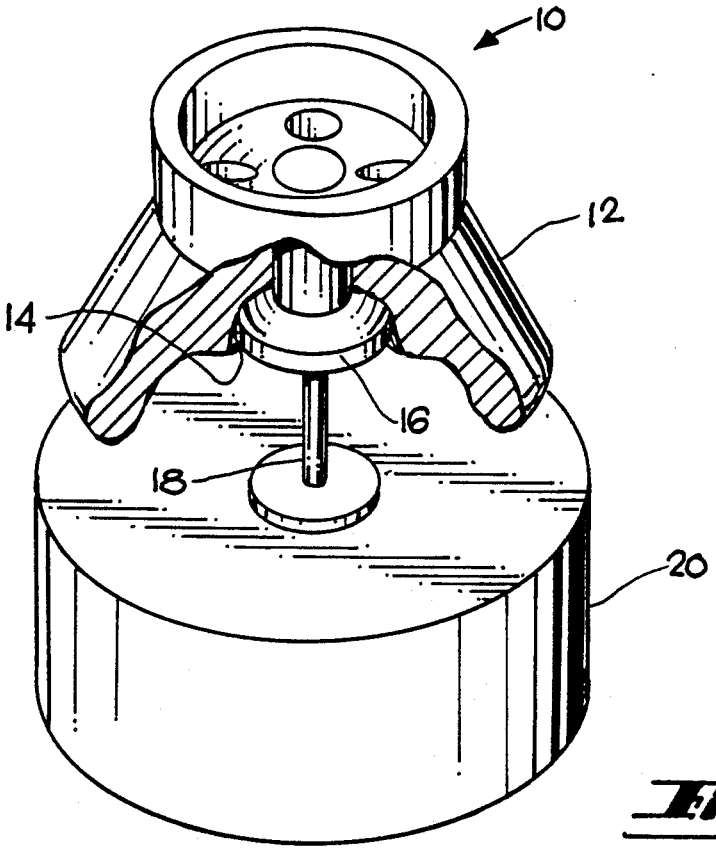
FIG. 1 is a perspective partially cut-away view of a centrifuge in accord with the present invention.

Referring to FIG. 1, a centrifuge 10 is depicted as having a rotor 12 mounted on top of a hub 16. The rotor 12 has an internal recess 14 which spacially accommodates the hub 16. Hub 16 is coupled to a motor 20 through a spindle 18. Motor 20 causes spindle 18 and hub 16 to rotate which, in turn, causes the rotor 12 to rotate because of a hub-rotor frictional interface. In ultracentrifuges, rotational speeds of 35,000 to over 100,000 rpm are obtained. These high speeds may generate centrifugal forces in excess of 600,000 g.

Figure 2A:
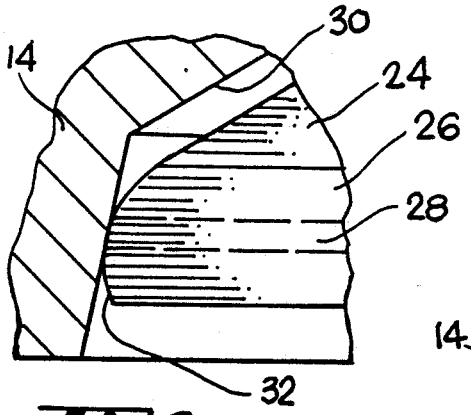
FIG. 2*a* is a side sectional detail of the interface within area 2*a* in FIG. 2.
Figure 2:
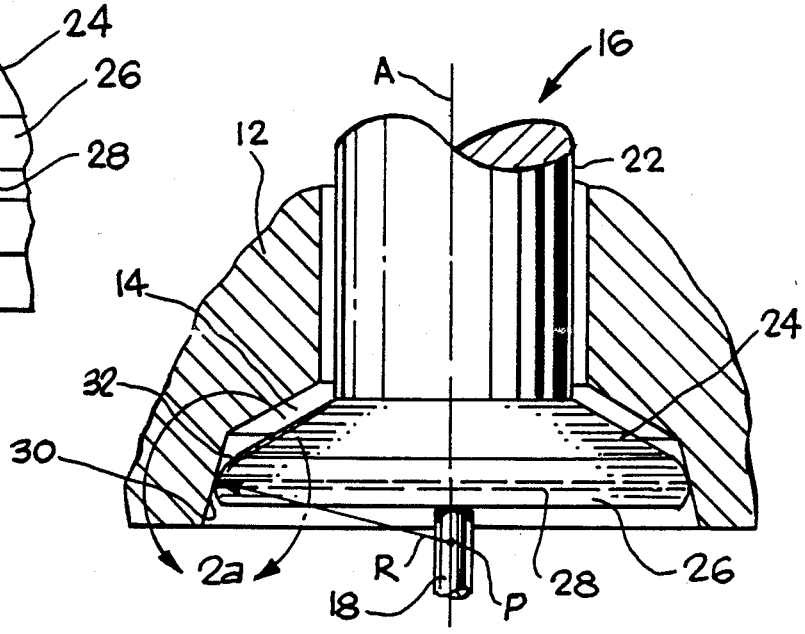
FIG. 2 is a side cut away view of the hub-rotor interface in the centrifuge of FIG. 1.

Referring now to FIG. 2, a hub-rotor interface is depicted wherein the hub 16 comprises a cylindrical extension 22, a transitional section 24, and a skirt 26. The internal recess 14 of the rotor 12 has a geometry of just slightly larger dimensions than the hub 16, so that the rotor fits over the hub. Spindle 18 couples the hub 16 to a drive means (not shown) such as an induction motor. Cylindrical section 22 and transitional section 24 help to locate and position the rotor onto the hub and keep it aligned during operation. Inwardly sloping wall 30 defines a tapered section of the recess 14, wherein the skirt 26 contacts the wall 30 along a circumferential zone or band of contact 28. An outer peripheral skirt surface 32 has a shape taken from the zone of a spheroid whose radius of curvature R is centered along drive shaft axis A near an imaginary pivot point P discussed more fully in relation to FIG. 3.

In FIG. 2*a* the interface between the tapered wall 30 and the skirt surface 32 is more readily seen. Skirt surface 32 is shown to contact the tapered wall 30 tangentially with the resulting circumferential band of contact 28. A broadened or extended zone of contact is provided by a relatively large radius of curvature of the skirt surface 32 when compared to the radii of curvature of prior art centrifuge hubs. While a circular radius is shown for skirt surface 32, it will be appreciated that an approximation of a circular radius will also work. In three dimensions, the zone is spheroidal, although an oblate or prolate spheroid will work as disclosed below.

Figure 3:
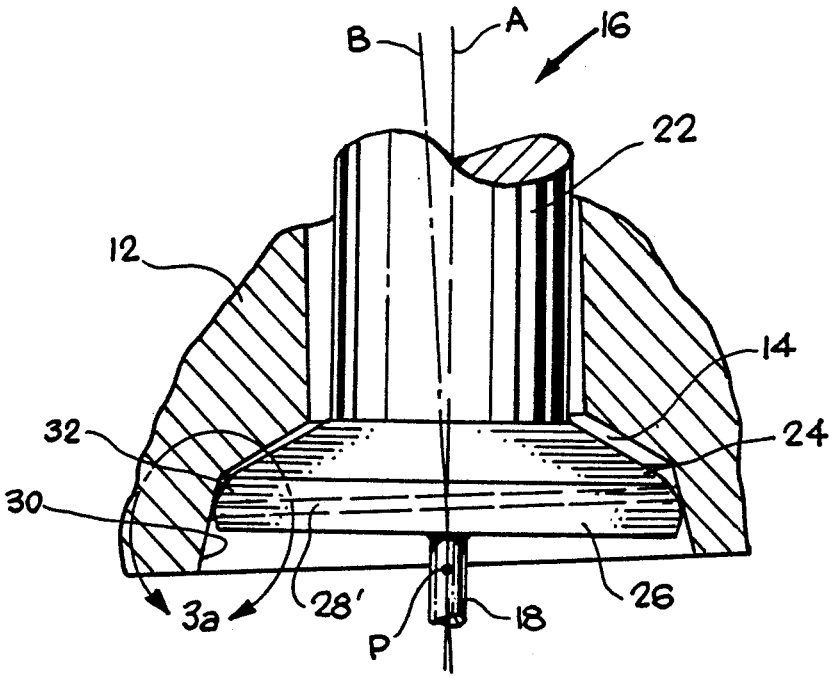
FIG. 3 is a side cut away view of the hub-rotor interface in the centrifuge of FIG. 1 shown in an exaggerated tilted condition.
Figure 3A:
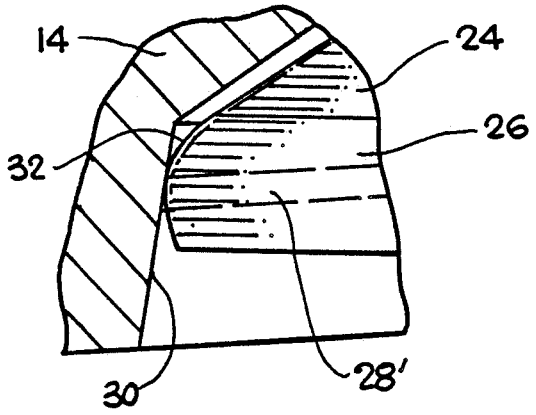
FIG. 3*a* is a side sectional detail of the interface within area 3*a* in FIG. 3.

Turning now to FIGS. 3 and 3*a*, an exaggerated tilted condition is illustrated wherein the hub 16 and the rotor 12 are tilted with respect to one another, as evidenced by hub spin axis A and rotor tilt axis B. Because of nominal tolerances between the recess 14 and the hub mating sections 22, 24 and 26, the rotor may pivot or tilt about pivot point P. Despite the large amount of tilt shown, an extended band of contact 28′ still encircles the skirt surface-tapered wall interface. Under normal operating conditions the amount of possible tilt will be small. The skirt 26 is designed to be sufficiently wide and has close tolerances to the taper so that the skirt surface 32 will come in contact with the inner sloping wall 30 regardless of the amount of tilt.

The tilting described so far has been due to the clearance between the hub 16 and the recess 14. It is desirable to minimize this type of tolerance related tilting. Another type of tilting occurs in high speed centrifuges because the rotor is allowed, to the extent practical, to rotate about its unconstrained axis of gyration. For this purpose the spindle 18 has a small diameter and is flexible enough to allow the rotor, under high speed conditions, to become slightly offset from its exact geometric axis by moving laterally and tilting. When the rotor has shifted to this self-balancing position, the spindle 18 will have deflected into a slightly "S" shaped curve.

Figure 4:
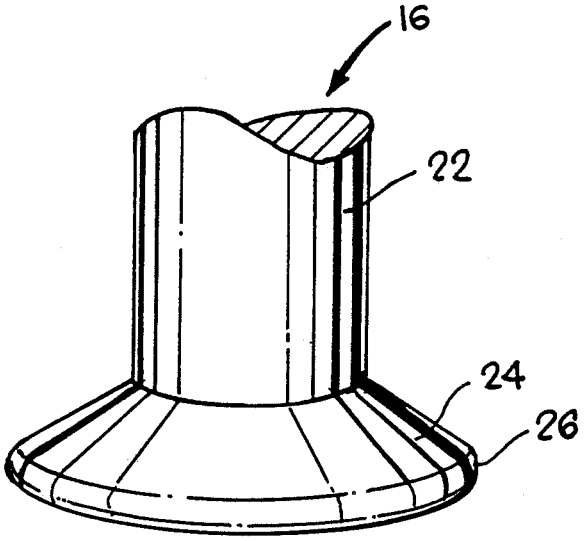
FIG. 4 is a perspective view of a spheroidally skirted hub in accord with the present invention.

FIG. 4 depicts a cylindrical extension 22, a conical section 24 and a spherical skirt 26. Skirt 26 is a portion of a spheroid that may be selected based on the amount of taper found in the rotors which will be used with the hub. The hub 16 is of one piece construction and is typically made from machined stainless steel or other suitable metals such as bronze, Monel and brass. Monel is a trademark for a metal consisting mainly of nickel and copper.

Figure 5:
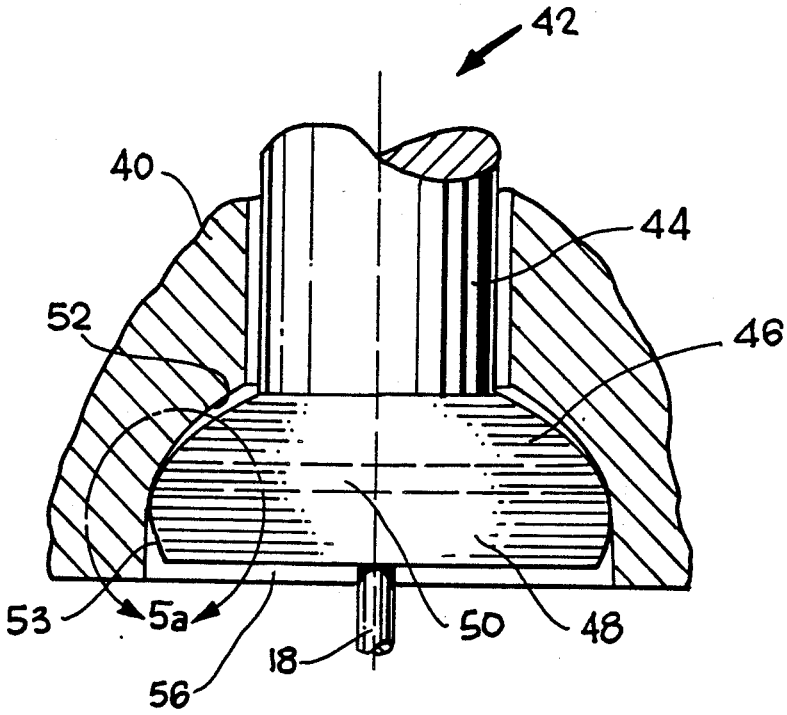
FIG. 5 is an enlarged side cut away view of a second embodiment of a hub-rotor interface of the present invention.
Figure 5A:
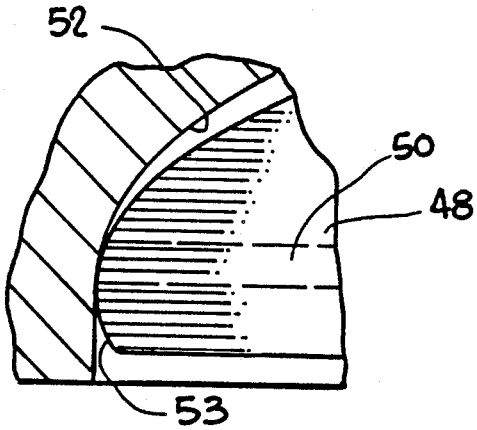
FIG. 5*a* is a side sectional detail of the interface within area 5*a* in FIG. 5.

Referring to FIGS. 5 and 5*a*, a second embodiment is depicted having a hub 42 with an oblate or prolate spheroidally curved skirt 48. A rotor 40 is shown having a curved internal wall 52 which interfaces with an annular band forming a portion of skirt surface 53. Hub 42 has a cylindrical extension 44 and a conical transitional section 46 disposed between the cylindrical extension and the skirt. Internal walls to the rotor 40 define a recess 52 having a spheroidally internally tapering section followed by a tapering conical section and a cylindrical section. The skirt 48 preferably has a rotor-engaging surface 58 that approximates a slightly asymmetric spheroid, either oblate, prolate or regular. Such a spheroid may have one curvature above a diameter and another curvature below the diameter, but for purposes of this invention, such differences in curvature are to be disregarded for defining the curved structure as a "spheroid". The spheroid should have a radius somewhat smaller than that of the spherically curved internal wall 52.

Figure 6:
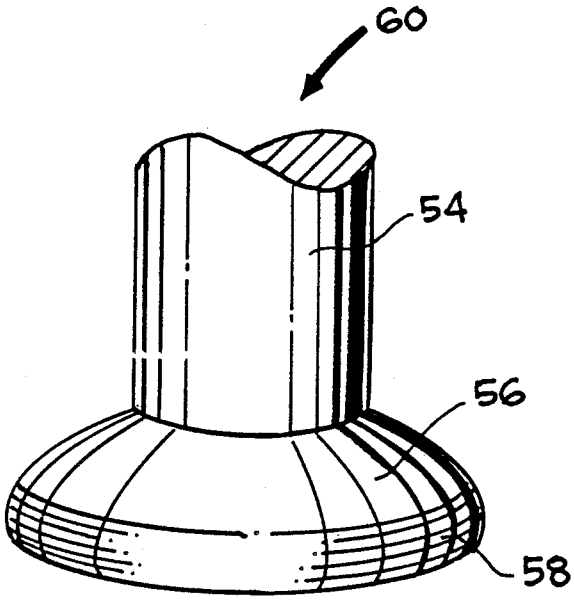
FIG. 6 is a perspective view of the hub shown in FIG. 5.

In FIG. 6, a hub 60 is illustrated as having a cylindrical extension 54, a conical tapered section 56 and a curved skirt 58. The skirt 58 has an outer shape taken from a portion of an oblate spheroid. Hub 60 is intended to be used with rotors having a spherically or similarly tapered bore and is made out of the same materials as the hub shown in FIG. 4.

I claim:

1. A centrifuge comprising:

a hub having a skirt with symmetry about a vertical drive shaft axis, the skirt defining a radially outward, rotor-engaging surface having a smooth, continuous curve profile in an axial plane, drive means for rotating the hub about the vertical drive shaft axis, and a rotor having an internal wall in frictional contact with the rotor-engaging surface for rotation therewith.

2. The centrifuge of claim 1 wherein said smooth, continuous curve is defined by a portion of an oblate spheroid having a minor axis coincident with the vertical drive shaft axis.

3. The centrifuge of claim 1 wherein said smooth, continuous curve has a circular profile.

4. The centrifuge of claim 3 wherein said circular profile has a radius of curvature whose center is along said vertical drive shaft axis below said skirt.

5. The centrifuge of claim 1 wherein said hub further includes a cylindrical extension coaxially above said skirt for initial positioning of said rotor onto said hub thereby constraining said rotor against excessive tilt.

6. An improved hub for rotational drive engagement in a centrifuge having a vertical drive shaft axis, the centrifuge including a drive means coupled to the hub for rotation of the hub about the vertical drive shaft axis, and further including a rotor having an internal, axially symmetric wall for receiving the hub in a rotational drive-engaging relationship, the improvement comprising, a hub skirt having an axially symmetric, radially outward surface with the shape of a slice of an oblate, prolate or regular spheroid, the slice having an axis of symmetry coincident with the vertical drive shaft axis.

7. The hub of claim 6 wherein said spheroid has a center of curvature along said vertical drive shaft axis.

8. The hub of claim 6 further comprising a cylindrical extension coaxially above said skirt for initial positioning of said rotor onto said hub, the cylindrical extension facing a cylindrical section of the rotor internal wall.

9. An improved hub for rotational drive engagement in a centrifuge having a vertical drive shaft axis, the centrifuge including a drive means coupled to the hub for rotation of the hub about the vertical drive shaft axis, and further including a rotor having an internal, axially symmetric wall for receiving the hub in a rotational drive-engaging relationship, the improvement comprising, a hub skirt having an axially symmetric, radially outward surface including an annular band portion with a smoothly curved peripheral profile in an axial plane, said band having a vertical extent defined by the range of possible drive engagement contact between the hub and rotor.

10. The hub of claim 9 wherein said band is a slice of a spheroid.

11. The hub of claim 10 wherein said spheroid is oblate.

12. The hub of claim 10 wherein said spheroid is prolate.

13. The hub of claim 10 wherein said band has a radius of curvature on said vertical drive shaft axis below said skirt.

14. The hub of claim 9 wherein the vertical extent of said band is in the range of 0.2 mm to 0.8 mm.

* * * * *